US006806852B2

(12) United States Patent
Ishizuka et al.

(10) Patent No.: US 6,806,852 B2
(45) **Date of Patent: *Oct. 19, 2004**

(54) METHOD AND APPARATUS FOR DRIVING SELF-EMITTING PANEL

(75) Inventors: Shinichi Ishizuka, Tsurugashima (JP); Masami Tsuchida, Tsurugashima (JP); Hideo Ochi, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 311 days.

This patent is subject to a terminal disclaimer.

(21) Appl. No.: 09/969,735

(22) Filed: Oct. 4, 2001

(65) Prior Publication Data

US 2002/0057234 A1 May 16, 2002

(30) Foreign Application Priority Data

Oct. 5, 2000 (JP) ..... 2000-306504

(51) Int. Cl.[7] ..... G09G 3/32
(52) U.S. Cl. ..... 345/77; 345/82

(58) Field of Search ..... 345/36, 55, 76, 345/77, 82, 83; 315/169.1, 169.2, 169.3, 169.4

(56) References Cited

U.S. PATENT DOCUMENTS 6,479,940 B1 * 11/2002 Ishizuka ..... 315/169.3
6,587,087 B1 * 7/2003 Ishizuka ..... 345/82
6,670,773 B2 * 12/2003 Nakamura et al. ..... 315/169.3

FOREIGN PATENT DOCUMENTS

JP 2000-259125 A 9/2000

* cited by examiner

*Primary Examiner*—Vijay Shankar
(74) *Attorney, Agent, or Firm*—Morgan, Lewis & Bockius LLP

(57) ABSTRACT

Improvement for extending the service life of a self-emitting panel and for reducing the power consumption thereof. The self-emitting panel is driven based on intensity-reduced data. The intensity-reduced data is obtained by applying intensity reduction processing on each frame of the image frame data to be displayed.

28 Claims, 6 Drawing Sheets

1 : WHITE LEVEL

0 : BLACK LEVEL

METHOD AND APPARATUS FOR DRIVING SELF-EMITTING PANEL

BACKGROUND OF THE INVENTION

1. Field of the Invention

The present invention relates to a method and apparatus for driving a self-emitting (self-luminous) panel such as an organic EL panel.

2. Description of the Related Art

Unlike a liquid crystal panel, a self-emitting panel such as an organic EL panel or a plasma display panel has a light emitting element which itself constitutes a picture element and emits light. The service life and the power consumption of each light emitting element depend on the product of total light emission time and light emission intensity (brightness, luminance).

If it is possible for a self-emitting panel driving apparatus to shorten the total light emission time of each light emitting element and/or to lower the light emission intensity thereof, it is then possible to extend the service life of the self-emitting panel and reduce the power consumption thereof.

Some efforts were made in the past to extend the life of self-emitting panels and to reduce the power consumption of the self-emitting panels.

SUMMARY OF THE INVENTION

An object of the present invention is to provide an improved method and apparatus for driving a self-emitting panel, which can extend the service life of the self-emitting panel and reduce the power consumption of the self-emitting panel.

According to one aspect of the present invention, there is provided a method of creating drive data for a respective frame of image frame data based on a data signal containing the image frame data, and driving a self-emitting panel based on the created drive data to display a two-dimensional image, the self-emitting panel having two crossing electrode groups such that intersecting points of the two electrode groups serve as light emitting points, the method comprising the steps of adjusting the image frame data such that intensity of at least one frame of the image frame data is reduced or adjusted, and creating the drive data based on the image frame data after the intensity adjustment.

According to another aspect of the present invention, there is provided an apparatus for driving a self-emitting panel based on a data signal containing image frame data to display a two-dimensional image, the self-emitting panel having two crossing electrode groups such that intersecting points of the two electrode groups serve as light emitting points, the apparatus comprising image frame creation means for extracting the image frame data from the data signal, intensity adjusting means for adjusting a value of the image frame data to reduce or adjust intensity of a respective frame of the image frame data, creation means for creating the drive data based on the image frame data of which intensity has been adjusted, and a driver for driving the self-emitting panel based on the drive data.

DETAILED DESCRIPTION OF THE INVENTION

Figure 1:
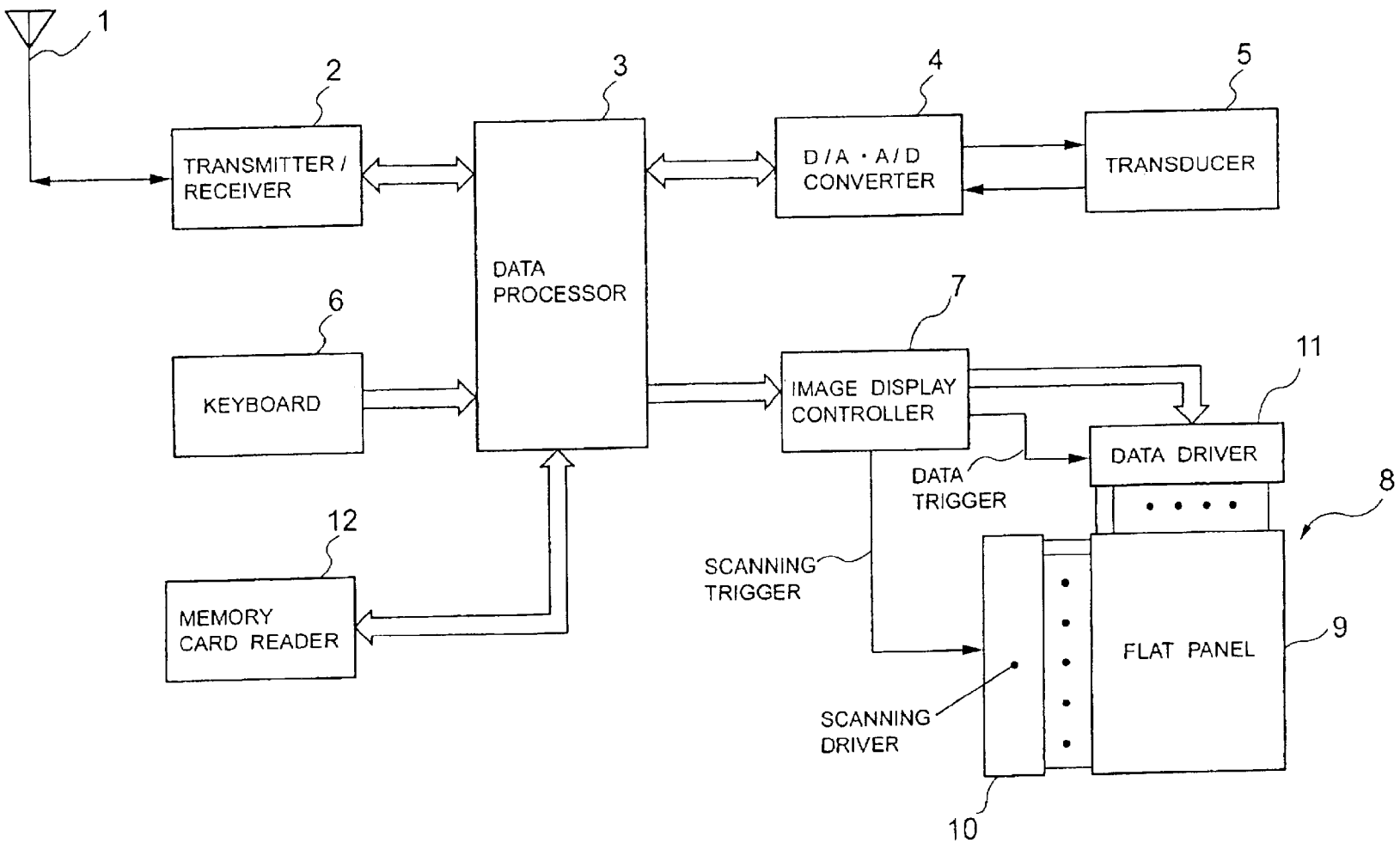
FIG. 1 is a block diagram of a transmitter/receiver arrangement including a panel driving apparatus of the present invention.

Referring to FIG. 1, illustrated is a transmitter/receiver arrangement including a panel driving apparatus according to the present invention. The transmitter/receiver arrangement is, for example, located in a receiving terminal such as a portable telephone terminal. A transmission/reception unit 2 transmits/receives a communication signal through an antenna 1. The transmission/reception unit 2 exchanges transmission/ reception data with a data processing circuit 3. If the data received from the transmission/reception unit 2 is audio data, the data processing circuit 3 forwards said audio data to a digital-to-analog/analog-to-digital converter circuit 4. The digital-to-analog/analog-to-digital converter circuit 4 converts the received audio data to an analog signal, and sends the resulting analog signal to a transducer 5 of a handset etc. for replaying it as sound. The transducer 5 is equipped with an audio analog signal creation means such as a microphone and sends the audio analog signal representing an operator's voice to the digital-to-analog/analog-to-digital converter circuit 4. The digital-to-analog/analog-to-digital converter circuit 4 converts this audio analog signal to audio data and sends it to the data processing circuit 3. The data processing circuit 3 forwards the audio data to the transmission/reception unit 2. The transmission/reception unit 2 converts this audio data to a predetermined communication format and transmits the resulting signal through the antenna 1.

The data processing circuit 3 executes various operation modes including said transmission/reception mode according to a command signal supplied via a keyboard 6.

For example, if the communication data received through the transmission/reception unit 2 contains image data together with an image display command, an image display mode for supplying an image display controller circuit 7 with an operation command together with its image data and synchronizing signal is executed.

The image display controller circuit 7 receives the image data together with the synchronizing signal in response to the operation command from the data processing circuit 3, controls an image display unit 8 including a flat panel 9, and performs an image display operation. The flat panel 9 includes a data electrode group and a scanning electrode group intersecting with each other, with a light emitting layer such as the organic EL layer being interposed between these two electrode groups. In addition, the flat panel 9 includes a scanning driver 10 and a data driver 11 in series between the electrode groups to radiate the light emitting layer at the electrode intersecting points as picture elements by applying a voltage between the electrode groups. The scanning driver 10 performs its function by applying a scanning pulse sequentially to each electrode of the scanning electrode group in synchronization with a scanning trigger pulse supplied from the image display controller circuit 7. Japanese Patent Kokai No. 2000-259125 discloses an example of a panel using such an organic EL.

In addition to a data trigger pulse, drive data is supplied to the data driver 11 from the image display controller circuit 7. The drive data is sent to the data driver 11 for each line of image data which corresponds to each scanning line. The data driver 11 supplies a voltage or current, which corresponds to one line of image data supplied in synchronization with the data trigger pulse, to each electrode of a data electrode group.

The data processing circuit 3 may also be able to obtain a data signal containing image frame data signals through a recording medium reader such as a memory card reader 12.

In addition, the data processing circuit 3 may be a data processing device such as a personal computer having no transmitting/receiving function.

Figure 2:
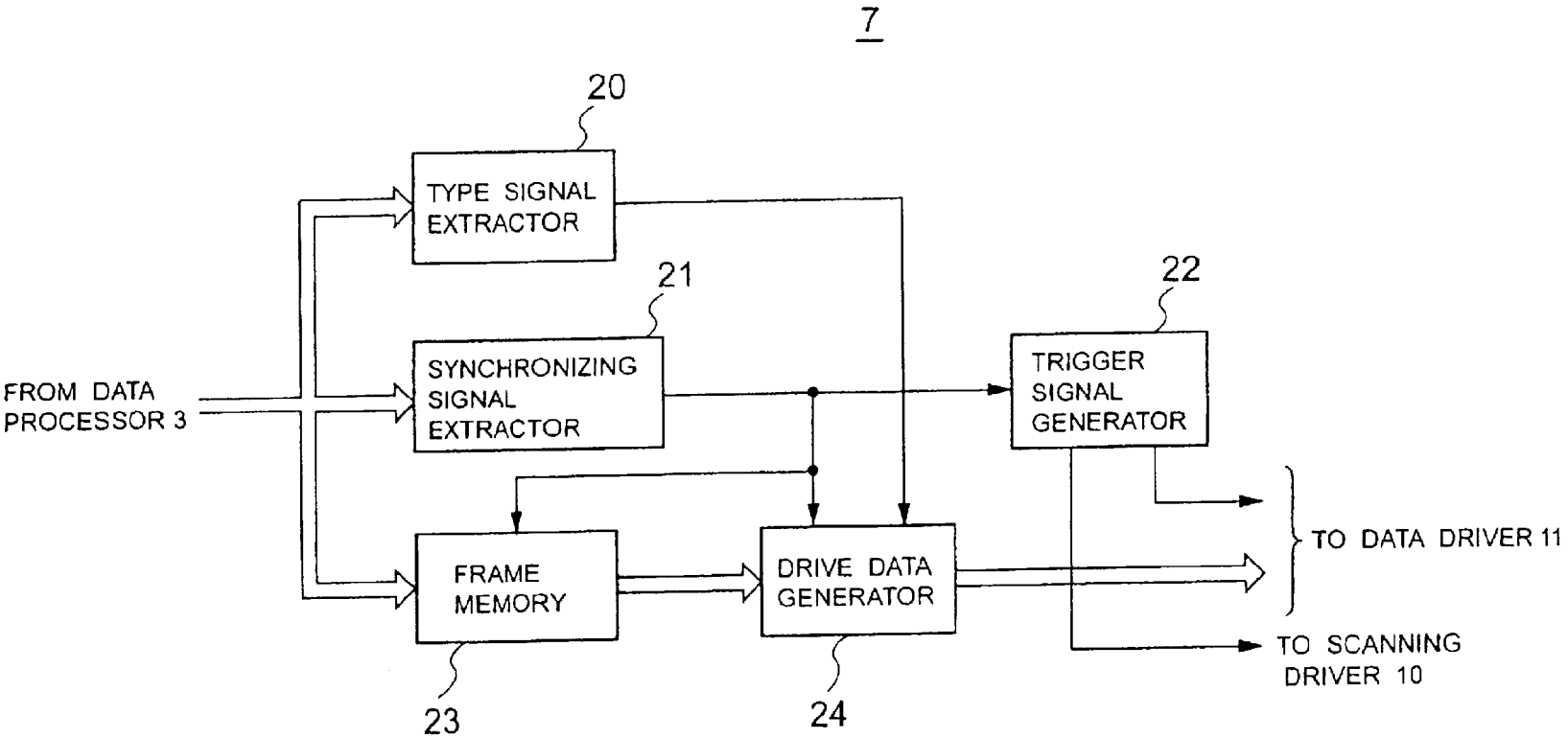
FIG. 2 is a block diagram of an exemplary circuit of an image display controller circuit of the present invention.

FIG. 2 shows an exemplary circuit of the above-mentioned image display controller circuit 7.

An image data signal is first sent to this control circuit 7 together with a command supplied from the data processing circuit 3. In many cases, this image data signal contains an image type signal which indicates whether the image carried by the image data is a static image or animation (non static image) or whether it contains characters only, and a synchronizing signal for reproducing the image. A type signal extractor circuit 20 extracts said image type signal from the image data signal input. A synchronizing signal extractor circuit 21 extracts the synchronizing signal contained in the image data signal input. This embodiment may be designed such that the data processing circuit 3 extracts said type signal and synchronizing signal. In this case, the image display controller circuit 7 does not require the type signal extractor circuit 20 and the synchronizing signal extractor circuit 21.

A trigger signal generator circuit 22 generates the above-mentioned scanning trigger pulse and data trigger pulse in accordance with the synchronizing signal sent from the synchronizing signal extractor circuit 21, and supplies these pulses to the scanning driver 10 and the data driver 11 respectively.

A frame memory 23 selectively takes image data among data supplied from the data processing circuit 3 frame by frame in synchronization with a synchronizing signal, and supplies the image data in the frame unit (frame by frame) to a drive data generator circuit 24.

The drive data generator circuit 24 generates drive data from the frame data supplied from the frame memory 23 in response to the synchronizing signal from the synchronizing signal extractor circuit 21 and the type signal from the type signal extractor circuit, and sends the drive data to the data driver 11.

Figure 3:
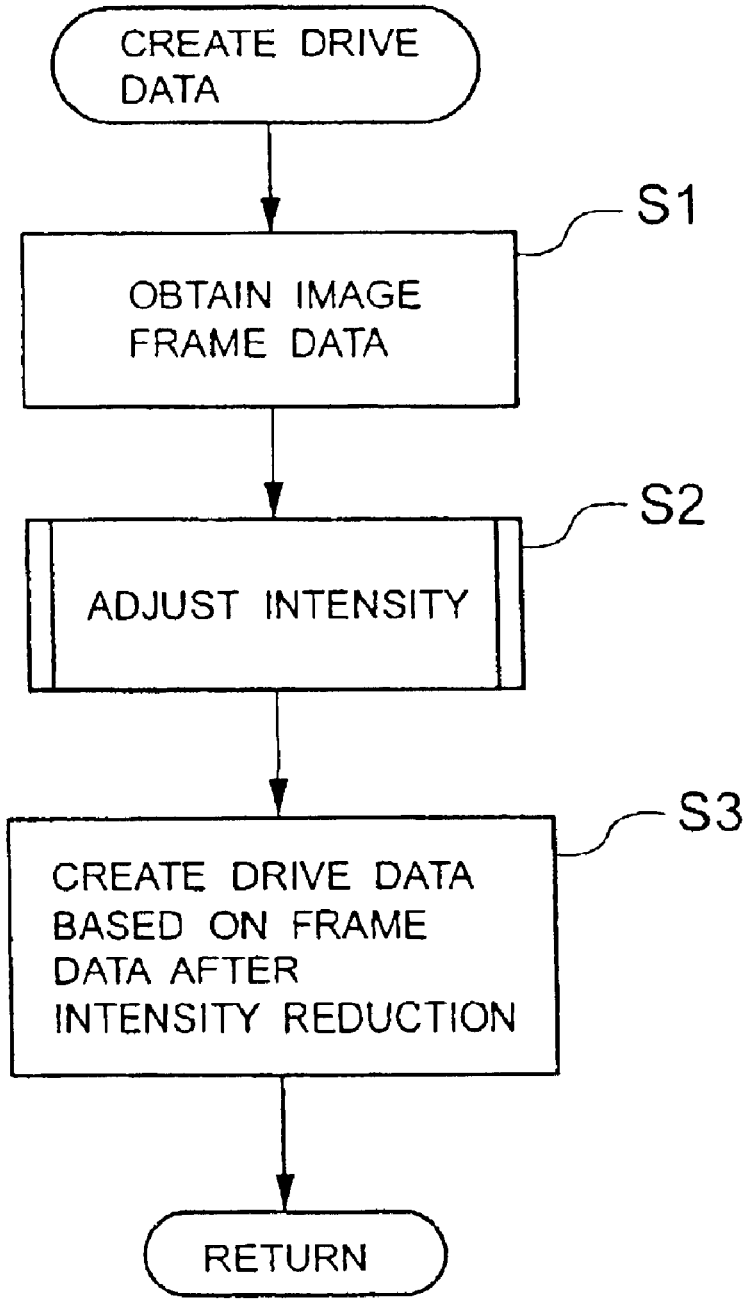
FIG. 3 is a flowchart of a drive data creation subroutine to be executed in the apparatus shown in FIG. 1.
Figure 4:
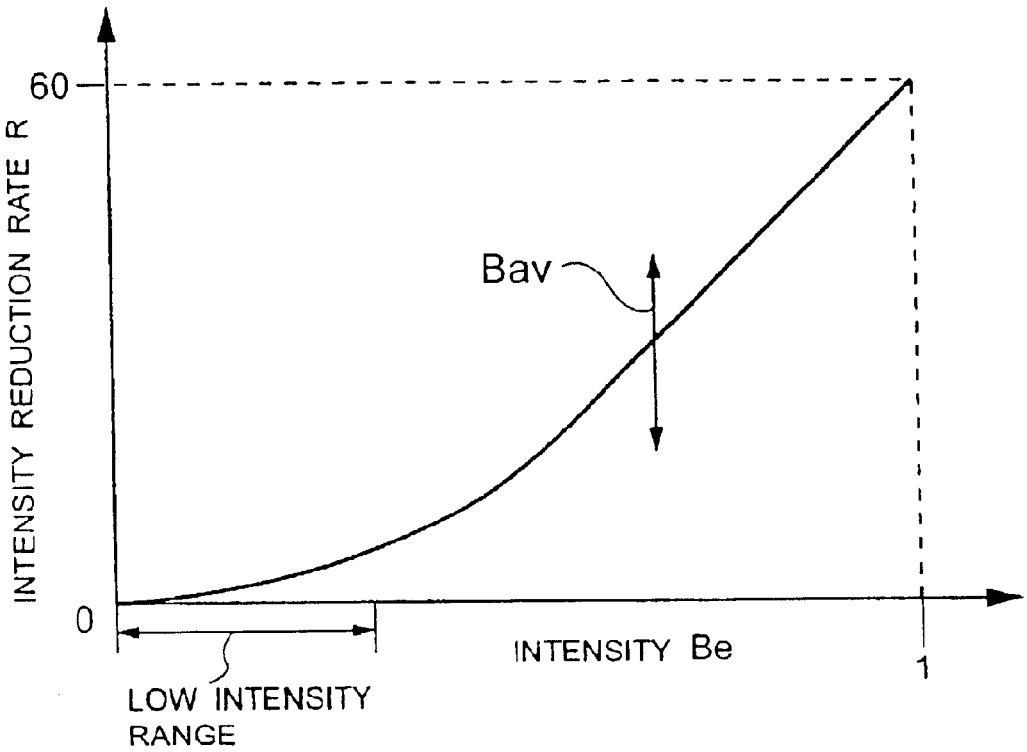
FIG. 4 is a graph showing exemplary changes in intensity reduction rate with respect to changes in picture element intensity in the intensity reduction processing in the subroutine shown in FIG. 3.

The drive data generator circuit 24 operates according to the subroutine in FIG. 3. That is, the drive data generator circuit 24 first accepts the image frame data supplied(step S1). The drive data generator circuit 24 then performs intensity (brightness, luminance) reduction processing to lower the intensity of the image frame data (step S2). After that, the drive data generator circuit 24 generates the above-mentioned drive data based on the image frame data which has undergone the intensity reduction processing (step S3). The intensity reduction processing in step S2 may be data processing that reduces the intensity Be of each picture element in the image frame data by a predetermined intensity reduction rate R. The intensity reduction rate R may be a constant, for example 40%, for each frame regardless of the magnitude of the intensity Be. As shown in FIG. 4, however, it is also possible to change the intensity reduction rate R with the magnitude of the intensity Be in each frame. In the example shown in FIG. 4, the reduction rate R is zero when the intensity Be is at the black level 0, the reduction rate R gradually increases with the increase in intensity Be in the low intensity range, and the reduction rate R increases substantially in proportion to the increase in intensity Be when intensity Be is outside the low intensity range. Further, the intensity reduction rate R may be shifted over the entire range of intensity Be according to the average intensity Bav of the frame. The average intensity Bav is obtained by dividing the total of intensity Be of the respective picture elements in the n'th frame by the number of picture elements N in the n'th frame, where n is a natural number.

It should be noted that not all the frames require the above-mentioned intensity reduction processing. For instance, it may be satisfactory to perform the intensity reduction processing to every other frame or every n'th frame.

In short, according to the present invention, the obtained image frame data undergoes the data processing to reduce the intensity of at least one frame without deteriorating the contour of the image. The self-emitting panel is driven based on the image frame data obtained in this manner.

Figure 5:
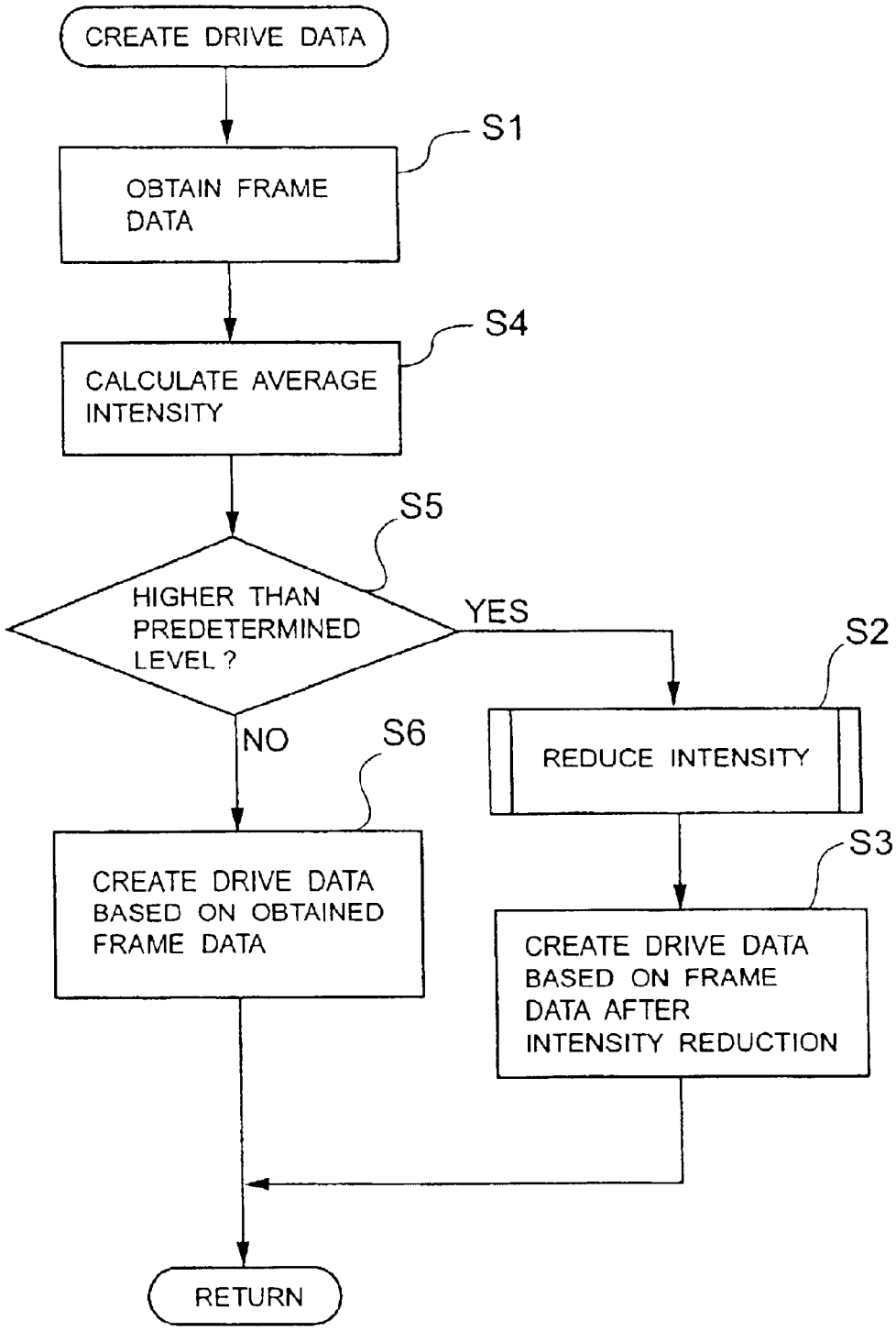
FIG. 5 is another flowchart of the drive data creation subroutine, which is different from that shown in FIG. 3.

FIG. 5 shows another drive data creation routine. In this routine, image frame data are fetched first (step S1), and then the average intensity Bav of the frame is calculated (step S4). Next, whether or not the average intensity Bav is higher than a predetermined level is determined (step S5). When it is determined that the average intensity Bav is higher than the predetermined level, intensity reduction processing similar to the intensity reduction processing shown in FIG. 3 is executed (step S2). Drive data are then generated based on the image frame data having the reduced intensity (step S3). When it is determined in step S5 that the average intensity Bav is equal to or below the predetermined level, drive data are generated based on the fetched image frame data without performing intensity reduction processing thereon (step S6).

Figure 6:
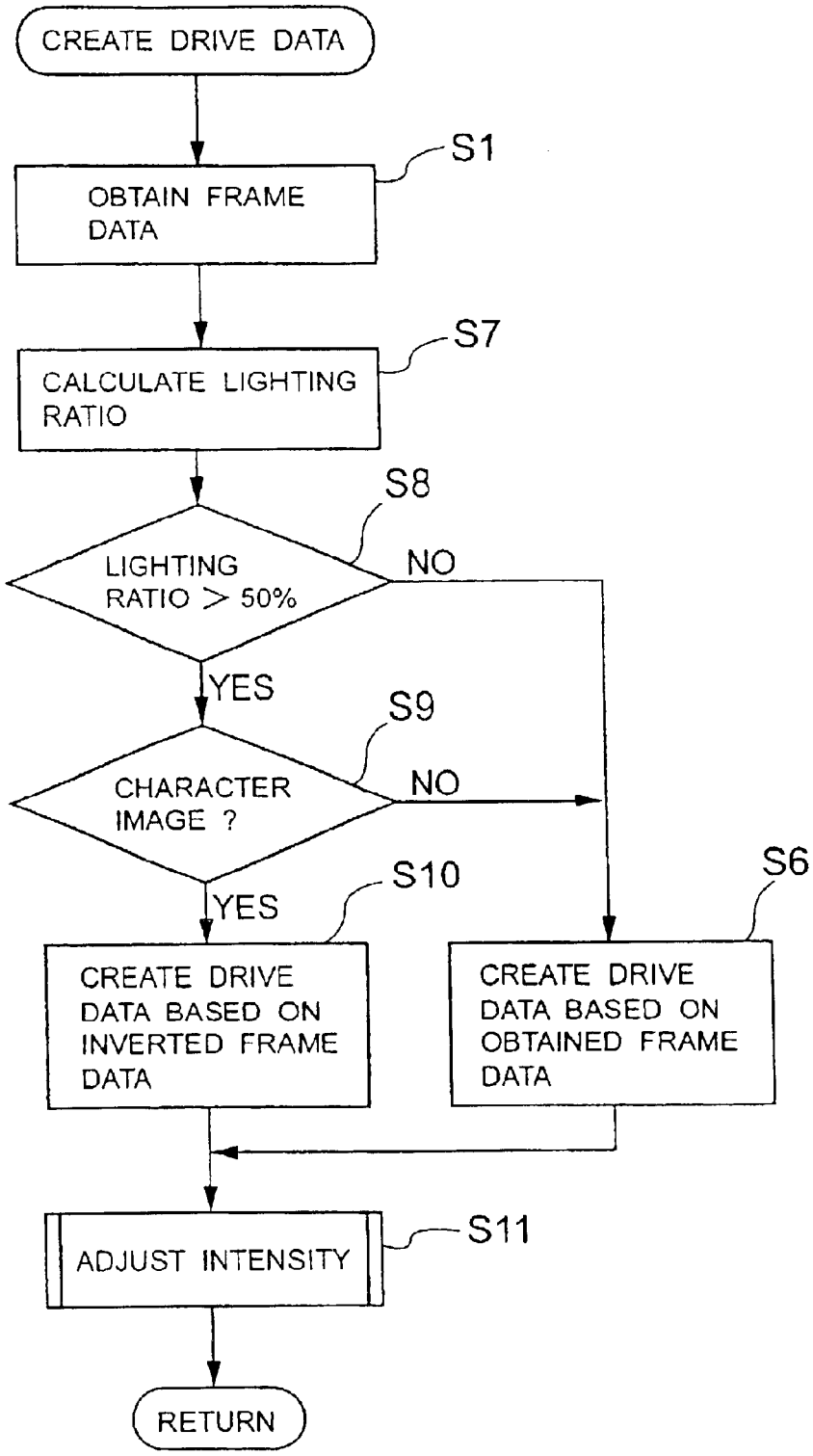
FIG. 6 is still another flowchart of the drive data creation subroutine.

FIG. 6 shows still another drive data creation routine. In this routine, image frame data are fetched first (step S1), and then the lighting ratio of the fetched image frame data is calculated for each frame (step S7). The lighting ratio is calculated by the following equation.

Lighting ratio=(number of light emitting picture elements in one frame)/(total number of picture elements in the same frame)

Whether or not the obtained lighting ratio is over 50% is then determined (step S8).

The light emitting picture element is not limited to the light emitting picture element of the white level but is one having an intensity of over a predetermined intermediate level.

When it is determined that the lighting ratio is 50% or less, the frame data themselves are used as drive data (step S6). When it is determined in step S8 that the lighting ratio of the fetched frame data is over 50%, on the other hand, it is then determined whether or not the frame data are data representing a character image (step S9). The determination in step S9 can be made by determining whether or not the type signal represents a character image. Alternatively, this determination may be made by determining whether the data processing circuit 3 is operating in a mode for ordinary conversation between subscribers, because it can be assumed that the screen has to display only numerals and characters when the data processing circuit 3 itself is operating for the ordinary conversation between the subscribers.

In step S9, if it is determined that the content of the frame data is not character information, the frame data are used as drive data as is (Step S6). In this step S9, on the other hand, if it is determined that the frame data is character information, the intensity of the frame data is inverted (reversed), and the resulting inverted frame data are used as the drive data (Step S10).

It may be satisfactory to transfer the drive data obtained in this manner to the data driver 11 without any modification or processing. In this routine, however, the intensity of each of the picture elements is adjusted such that the total intensity of all the picture elements in each frame of the drive data becomes an adequate value (Step S11).

In the above-described embodiment the transmission/reception system uses the panel drive apparatus of the present invention. It should be noted, however, that the present invention is not limited in this regard. The panel drive apparatus of the present invention can be applied to any equipment utilizing a panel display device, such as a television set, personal computer, etc.

As described above, the panel drive apparatus of the present invention creates the drive data according to the intensity reduced frame data, which is obtained by applying the intensity reduction processing to the frame data to be displayed, and drives the self-emitting panel with such drive data. Consequently, the service life of the panel can be extended and the power consumption of the panel can be saved.

This application is based on Japanese patent application No. 2000-306504 which is incorporated herein by reference.

What is claimed is:

1. A method of creating drive data for a respective frame of image frame data according to a data signal containing the image frame data, and driving a self-emitting panel based on the created drive data to display a two-dimensional image, the self-emitting panel having two crossing electrode groups such that intersecting points of the two electrode groups serve as light emitting points, the method comprising:

an intensity reduction step of performing intensity reduction processing for said image frame data to lower picture element intensity of at least one frame of the image frame data; and a creation step of creating said drive data based on the image frame data after the reduction of the intensity.

2. A method according to claim 1, wherein said intensity reduction step includes a data processing step of lowering the intensity of each picture element of said image frame data by a predetermined reduction rate.

3. A method according to claim 2, wherein said intensity reduction rate is a constant value regardless of the intensity of the picture element which is subject to the intensity reduction step.

4. A method according to claim 2, wherein said intensity reduction rate is a value that varies with the intensity of the picture element subject to the intensity reduction step.

5. A method according to claim 2, wherein said intensity reduction rate becomes higher along with the increase in the intensity of the picture element subject to the intensity reduction step.

6. A method according to claim 5, wherein the intensity reduction rate becomes higher more gently in a low intensity range in which the intensity of the picture element subject to the intensity reduction step is low than a range outside the low intensity range.

7. A method according to claim 2, wherein said intensity reduction rate changes with an average intensity of a whole screen resulting from the frame of the image frame data subject to the intensity reduction step.

8. A method according to claim 1 further including an average intensity detection step of determining whether the average intensity of a picture element in the frame of the image frame data subject to the intensity reduction step is greater than a predetermined average intensity, wherein said intensity reduction step is executed only when it is determined in the average intensity detection step that the average intensity of said picture element in the frame exceeds the predetermined average intensity.

9. A method according to any one of the preceding claims, wherein the intensity reduction rate is selected so as not to deteriorate a contour of an image frame resulting from the frame of said image frame data.

10. A method according to claim 1, wherein said intensity reduction step includes:

a detection step of determining whether an image frame resulting from the frame of said image frame data is an image containing character image only and a lighting ratio of said image frame exceeds 50%; and an inversion step of inverting the intensity of the image frame data which corresponds to the image frame when it is determined in said detection step that the image frame of said image frame data contains character image only and the lighting ratio of said image frame exceeds 50%.

11. A method according to claim 10, wherein said detection step determines whether the image frame is an image containing character image only based on an information type signal contained in said data signal.

12. A method according to claim 10, wherein said intensity reduction step includes an intensity adjustment step to be executed after said inversion step.

13. A method according to claim 1, wherein said self-emitting panel is an organic EL panel.

14. A method according to claim 9, wherein said self-emitting panel is an organic EL panel.

15. An apparatus for driving a self-emitting panel based on a data signal containing image frame data to display a two-dimensional image, the self-emitting panel having two crossing electrode groups such that intersecting points of the two electrode groups serve as light emitting points, the apparatus comprising:

image frame creation means for extracting said image frame data from said data signal;

intensity reduction means for adjusting a value of said image frame data to reduce intensity of a respective frame of said image frame data;

creation means for creating said drive data based on the image frame data of which intensity has been reduced; and a driver for driving said self-emitting panel based on said drive data.

16. An apparatus according to claim 15 further including data signal accepting means for accepting said data signal through an operation input device, transmission/reception device or recording medium.

17. A method according to claim 11, wherein said intensity reduction step includes an intensity adjustment step to be executed after said inversion step.

18. A method according to claim 2, wherein said self-emitting panel is an organic EL panel.

19. A method according to claim 3, wherein said self-emitting panel is an organic EL panel.

20. A method according to claim 4, wherein said self-emitting panel is an organic EL panel.

21. A method according to claim 5, wherein said self-emitting panel is an organic EL panel.

22. A method according to claim 6, wherein said self-emitting panel is an organic EL panel.

23. A method according to claim 7, wherein said self-emitting panel is an organic EL panel.

24. A method according to claim 8, wherein said self-emitting panel is an organic EL panel.

25. A method according to claim 10, wherein said self-emitting panel is an organic EL panel.

26. A method according to claim 11, wherein said self-emitting panel is an organic EL panel.

27. A method according to claim 12, wherein said self-emitting panel is an organic EL panel.

28. A method according to claim 17, wherein said self-emitting panel is an organic EL panel.

* * * * *